US007059532B2

(12) United States Patent
McCumber

(10) Patent No.: US 7,059,532 B2
(45) Date of Patent: Jun. 13, 2006

(54) SYSTEM AND METHOD FOR STORING AND SYNCHRONIZING FORMS BETWEEN PRINTER AND DEVICE FOR ATTACHING PERSONALIZED CARDS BY CREATING SHINGLED STACKS

(75) Inventor: Roger D. McCumber, Minnetonka, MN (US)

(73) Assignee: DataCard Corporation, Minnetonka, MN (US)

( * ) Notice: Subject to any disclaimer, the term of this patent is extended or adjusted under 35 U.S.C. 154(b) by 67 days.

(21) Appl. No.: 10/340,171

(22) Filed: Jan. 9, 2003

(65) Prior Publication Data

US 2004/0139242 A1 Jul. 15, 2004

(51) Int. Cl.
*G06K 19/06* (2006.01)
*G06F 13/00* (2006.01)

(52) U.S. Cl. ..... 235/491; 710/8; 710/9; 710/10; 710/33; 710/52; 53/54; 53/157; 493/16; 493/193; 493/395; 493/417

(58) Field of Classification Search ..... 710/8–10, 710/33, 52; 53/54, 157; 235/491; 493/16, 493/417, 393, 395
See application file for complete search history.

(56) References Cited

U.S. PATENT DOCUMENTS

| | | | | |
|---|---|---|---|---|
| 2,190,413 | A | 2/1940 | Davidson | |
| 3,622,149 | A | 11/1971 | Enskat | |
| 3,753,559 | A | 8/1973 | Ries et al. | |
| 3,883,133 | A | 5/1975 | Rebres | |
| 4,194,685 | A | 3/1980 | Hill et al. | |
| 4,358,102 | A | 11/1982 | Hoshizaki et al. | |
| 4,384,196 | A | 5/1983 | McCumber et al. | |
| 4,616,815 | A | 10/1986 | Vijuk | |
| 4,992,950 | A | 2/1991 | Francisco | |
| 5,074,398 | A | 12/1991 | Meier | |
| 5,246,415 | A | 9/1993 | Fuss | |
| 5,266,781 | A | 11/1993 | Warwick et al. | |
| 5,282,614 | A | 2/1994 | Kalisiak et al. | |
| 5,289,251 | A | 2/1994 | Mandel et al. | |
| 5,429,349 | A | 7/1995 | Supron et al. | |
| 5,449,165 | A | 9/1995 | Naramore | |
| 5,451,037 | A | 9/1995 | Lundstrom | |
| 5,842,722 | A * | 12/1998 | Carlson | 283/107 |
| 6,042,528 | A | 3/2000 | McCumber et al. | |
| 6,629,006 | B1 * | 9/2003 | Weinmann | 700/100 |

FOREIGN PATENT DOCUMENTS

| | | |
|---|---|---|
| DE | 40 05 372 A1 | 8/1991 |
| EP | 0 406 827 A1 | 1/1991 |
| WO | WO 92/16447 | 10/1992 |
| WO | WO 95/22462 | 8/1995 |

* cited by examiner

*Primary Examiner*—Tammara Peyton
(74) *Attorney, Agent, or Firm*—Hamre, Schumann, Mueller & Larson, P.C.

(57) ABSTRACT

An apparatus that stores and synchronizes printed forms that are being transferred between a high speed forms printer and a mechanism for attaching plastic cards to the forms. The apparatus is also able to buffer the forms that are in progress in the printer should the card processing system need to be shut down or paused. The apparatus creates a shingled stack of forms, with the bottommost form in the stack being fed to the attaching mechanism as needed.

16 Claims, 6 Drawing Sheets

SYSTEM AND METHOD FOR STORING AND SYNCHRONIZING FORMS BETWEEN PRINTER AND DEVICE FOR ATTACHING PERSONALIZED CARDS BY CREATING SHINGLED STACKS

FIELD OF THE INVENTION

The invention relates to card processing systems which process data bearing plastic cards, such as credit cards, driver's licenses, identification cards and the like. More particularly, the invention relates to an apparatus for use in a card processing system in which the apparatus is adapted to handle printed forms to which data bearing plastic cards are eventually attached.

BACKGROUND OF THE INVENTION

Card processing systems currently in use include apparatus for performing processing operations on the plastic cards, such as printing, embossing, laminating and the like. Many of these card processing systems are formed as modular systems composed of a plurality of separate modules, each of which is designed to perform a particular processing function or functions. The modules can be taken out of, or inserted into, the system so that the system can be adapted to the changing needs of the user. An example of a modular card processing system is the Maxsys system and the 9000 system, each of which is produced by DataCard Corporation of Minnetonka, Minn.

Card processing systems also often include apparatus for producing and processing printed forms or sheets to which the plastic cards are subsequently attached for sending to customers. The printed forms are typically produced in a high speed printer. Each printed form contains, for example, personal information thereon related to a particular customer. Each printed form is then matched with the corresponding plastic card(s) for the customer downstream of the printer.

The form printing operation can often occur at a faster rate than the card personalization operation, which means that the forms will not be completed at the same time as the card(s) to be attached thereto. Therefore, the forms must be handled while waiting for the card(s) to be finished.

In addition, on certain occasions, a card processing system can develop a fault in one or more of its modules which requires that the system be paused or stopped to correct the problem. If this occurs, card processing stops. This can create difficulties in matching the correct printed form with the correct card(s). In the past, if the system has been paused, the forms that are in progress in the printer have often been thrown away because the sheets that are in progress in the printer cannot be stopped. Since each printed form contains personal information for a particular customer which must be mated downstream of the printer with the appropriate plastic card, it is difficult to reprint each of the customer specific printed forms and match the reprinted forms with the appropriate plastic card.

One way to eliminate the need to dispose of forms, and to handle forms while they wait for card personalization to be complete, is to utilize a buffer between the printer and the mechanism that mates the cards and forms. A buffer is designed to hold the forms that were in progress in the printer when the system is paused, and to handle forms while the card(s) to be attached thereto are completed. The buffer holds the printed forms until the system is restarted and the card(s) is ready to be attached, at which point the correct form can then be matched with its correct card(s). An example of a buffer is disclosed in U.S. Pat. No. 6,042,528.

An additional problem that is presented when matching printed forms with data bearing cards is that the size of the paper used to print the forms may vary depending upon the requirements of the intended customer. For example, some customers may want Letter sized forms, while others may want A4 sized forms. Therefore, if a buffer is used, it needs to be designed to accommodate the differing paper sizes that are often used for forms.

SUMMARY OF THE INVENTION

The invention relates to a method and apparatus used with a card processing system that produces data bearing plastic cards. The apparatus stores and synchronizes printed sheets that are being transferred between a high speed forms printer and a mechanism for attaching the plastic cards to the forms. The apparatus is also able to buffer the sheets that are in progress in the printer should the card processing system need to be shut down or paused.

In one aspect of the invention, a method of storing and synchronizing forms being transferred between a forms printer and a device for attaching personalized cards to the forms is provided. The method comprises providing a forms buffer apparatus between the printer and the attaching device, discharging forms from the printer into the forms buffer apparatus, stacking the forms in the forms buffer apparatus so that a leading edge of each form is set back from the leading edge of the form immediately beneath it thereby creating a shingled stack, moving the shingled stack toward an output to discharge the lowermost form from the shingled stack, and moving the shingled stack back to a home position to permit reception of another form onto the top of the shingled stack.

In another aspect of the invention, an apparatus for storing and synchronizing forms that are transferred between a forms printer and a device for attaching personalized cards to the forms is provided. The apparatus comprises an input configured to permit reception of forms from the forms printer, an output through which forms are discharged to the device for attaching personalized cards, and a stack area between the input and output that is configured and arranged to contain a stack of forms. A first mechanism is configured and arranged to transport forms from the input to the stack area, and a second mechanism at the stack area is configured and arranged to transport the stack of forms toward and away from the output.

One advantage of the apparatus and method of the invention is that it can operate at high speeds. For example, the apparatus and method can operate at up to 3000 forms per hour, which is fast enough to work with DataCard Corporation's Maxsys System. In addition, the apparatus can work with a wide range of printers and card processing systems, as well as accommodate a wide range of operating speeds. Further, the apparatus can operate over a wide range of paper parameters, including various paper sizes, moisture contents, paper weights and paper types. The apparatus is also simple in construction and has few parts that require maintenance.

For a better understanding of the invention, its advantages and objects obtained by its use, reference should be made to the drawings which form a further part hereof, and to the accompanying description, in which there is described a preferred embodiment of the invention.

DETAILED DESCRIPTION OF THE INVENTION

Figure 1:
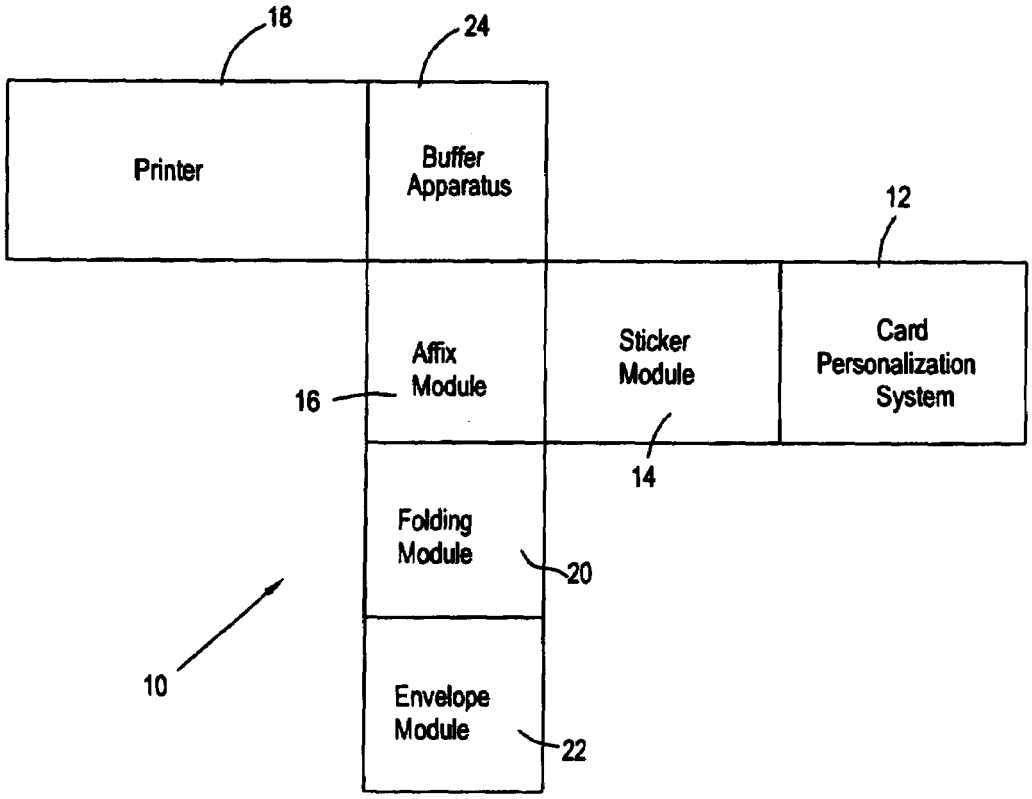
FIG. 1 is a schematic depiction of a modular card processing system employing the apparatus of the invention.

The invention relates to card processing systems which process data bearing plastic cards, such as credit cards, driver's licenses, identification cards and the like. With reference to FIG. 1, a card processing system 10 is illustrated. The system 10 includes a card personalization system 12 which is capable of personalizing plastic cards with data specific to the intended card holder, as well as perform other processing operations on the cards. Examples of card personalization and processing that can occur includes magnetic stripe programming, integrated circuit chip programming, embossing, monochromatic printing, multicolor printing, laser engraving, card cleaning, and top coat application. Other personalization and processing operations known to those of skill in the art having read this specification are possible. The system 12 is preferably a modular card personalization system, for example the Maxsys system available from DataCard Corporation of Minnetonka, Minn., or the system disclosed in U.S. Pat. No. 5,266,781.

Properly personalized cards produced by the system 12 are then output to a sticker module 14 which applies an adhesive material to the cards so that the cards can be attached to forms for mailing to the intended card holders. The adhesive material that is applied can be in the form of at least one sticker that is applied to the backside of the cards. Alternatively, the adhesive material can be a suitable glue. Adhesive materials that would be suitable for affixing plastic cards to forms would be known to those of skill in the art having read this specification.

After the adhesive material is applied, the cards are then transported to an affix module 16 at which the cards are affixed to forms for subsequent mailing. The affix module 16 also receives printed forms from a printer 18. The printer 18 prints cardholder specific data and other data onto paper sheets to produce forms for mailing to intended cardholders. The printer 18 is preferably a high-speed printer, and can be configured to perform black-and-white printing or color printing. An example of a suitable printer for use with the invention is the Hitachi DDP 70 printer, available from Hitachi America, Ltd. The forms are preferably either Letter sized (i.e. 216 mm×279 mm) or A4 sized (i.e. 210 mm×297 mm), although other paper sizes could be used.

The affix module 16 receives both cards and printed forms, and affixes one or more cards to the appropriate form for that card. An example of a suitable affix module for use with the invention is the Ultraform Card Affixer available from DataCard Corporation of Minnetonka, Minn.

The forms with the cards attached are then transported to a folding module 20 which folds the forms for mailing. An example of a suitable folding module for use with the invention is the Ultraform Folder available from DataCard Corporation of Minnetonka, Minn.

The folded forms are then transported to an envelope module 22 which takes the folded forms and inserts them into an envelope for mailing. An example of a suitable envelope module for use with the invention is the PFE Automailer 3 Envelope Inserter available from PFE International Ltd. of Essex, England.

Disposed between the printer 18 and the affix module 16 is a buffer apparatus 24 according to the invention. The apparatus 24 is configured to synchronize forms being transferred between the printer 18 and the affixer 16 so that the proper form arrives at the affix-module at the correct time to be matched with the proper card(s) for that form.

The apparatus 24 is also configured to store forms that are in progress within the printer 18 in the event that the card personalization system 12, or any other module of the system 10, develops an error that requires the card personalization system 12 to be shut down. If the system 12 is shut down, further card personalization stops until the system is again restarted. The apparatus 24 maintains the order of the forms so that when the system 12 is restarted, the forms can be fed to the affix module 16 in proper order so that the proper form can be matched with the proper card(s). Preferably, there are never more than six forms in the printer 18 and buffer apparatus 24 at any one time. As a result, at most six forms will collect in the apparatus 24.

The apparatus 24 is preferably in the form of a module. The use of modular components in the system 10 permits rearrangement and reconfiguration of the system 10, as well as making replacement of a defective module easier.

Turning now to FIGS. 2–6, details of the buffer apparatus 24 are illustrated. The apparatus 24 includes a support frame 26 that supports the various components of the apparatus 24. In use, the support frame 26 is preferably mounted within a housing (not shown) which defines the exterior appearance of the apparatus 24. The specific construction of the support frame 26 can vary, as long as it is able to perform its function of supporting the components of the apparatus 24.

Figure 3:
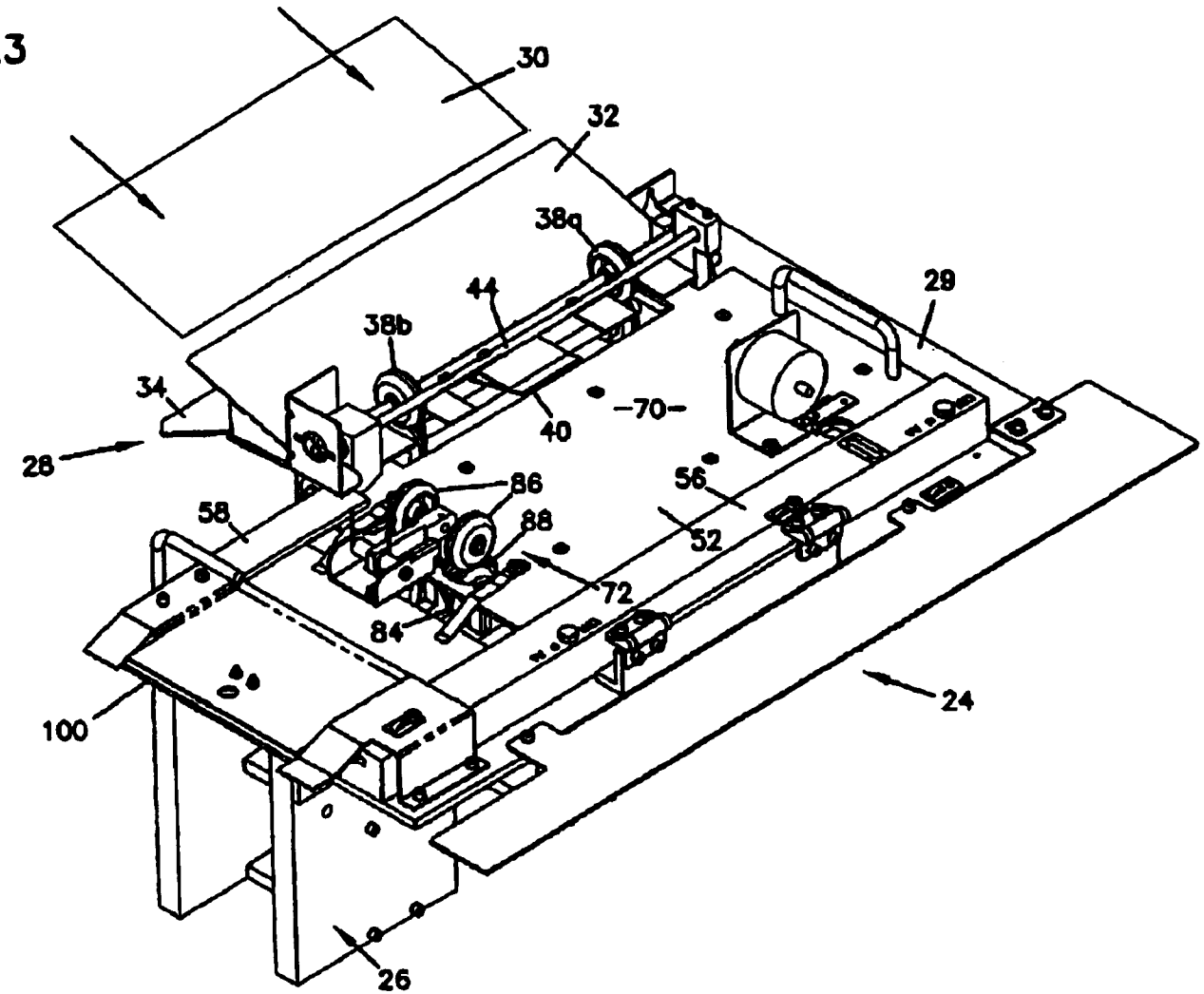
FIG. 3 is a perspective view of the apparatus with the top plate of the guide path removed.
Figure 6:
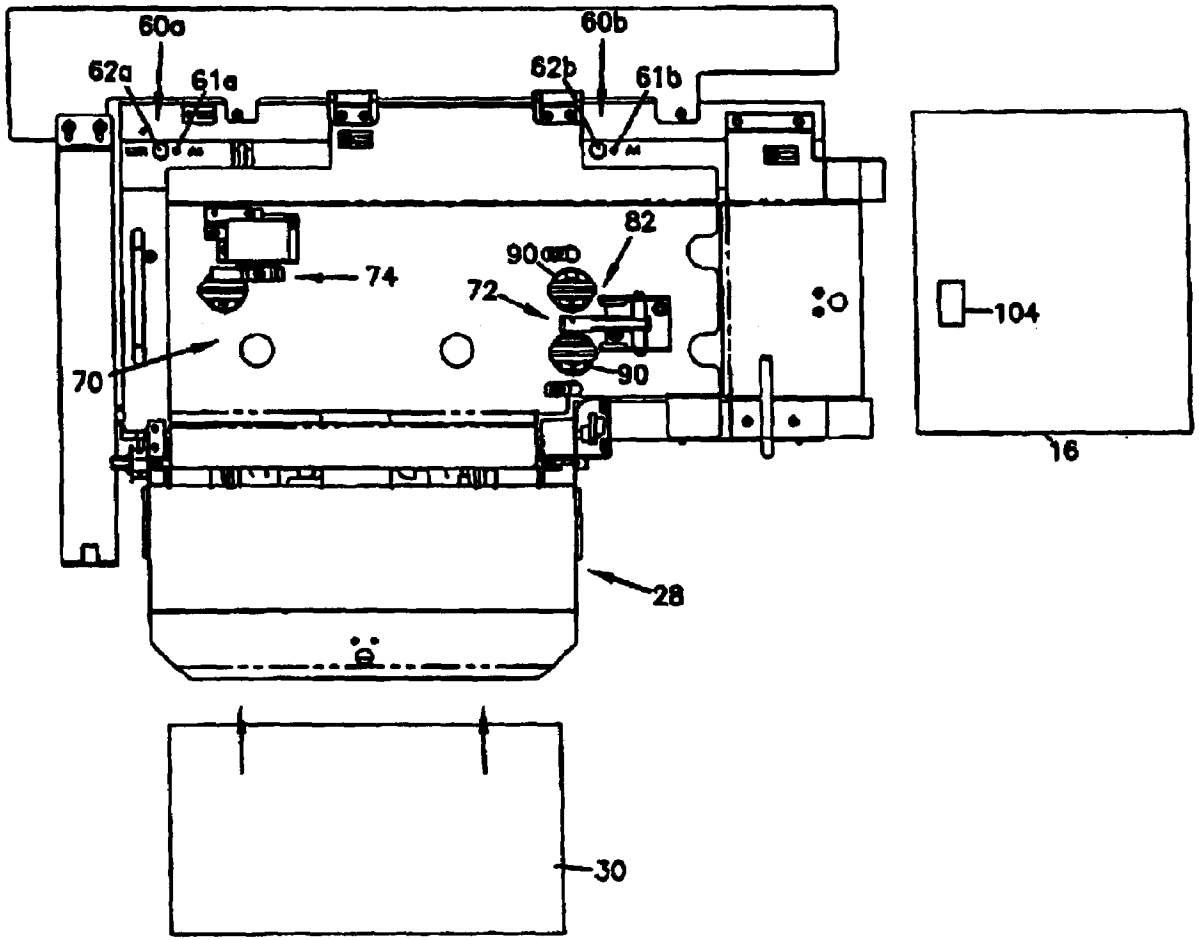
FIG. 6 is a top view of the apparatus.

A forms input 28 is defined adjacent an end of the apparatus 24. The input 28 is configured to permit reception of forms from the printer 18 after the forms have been printed. A form 30 is illustrated in FIGS. 3 and 6 about to enter the apparatus 24 through the input 28. The input 28 is arranged so that the forms enter the apparatus 24 side edge first. Alternatively, the input could be arranged at the end 29 of the apparatus 24 with the forms entering leading edge first.

Figure 2:
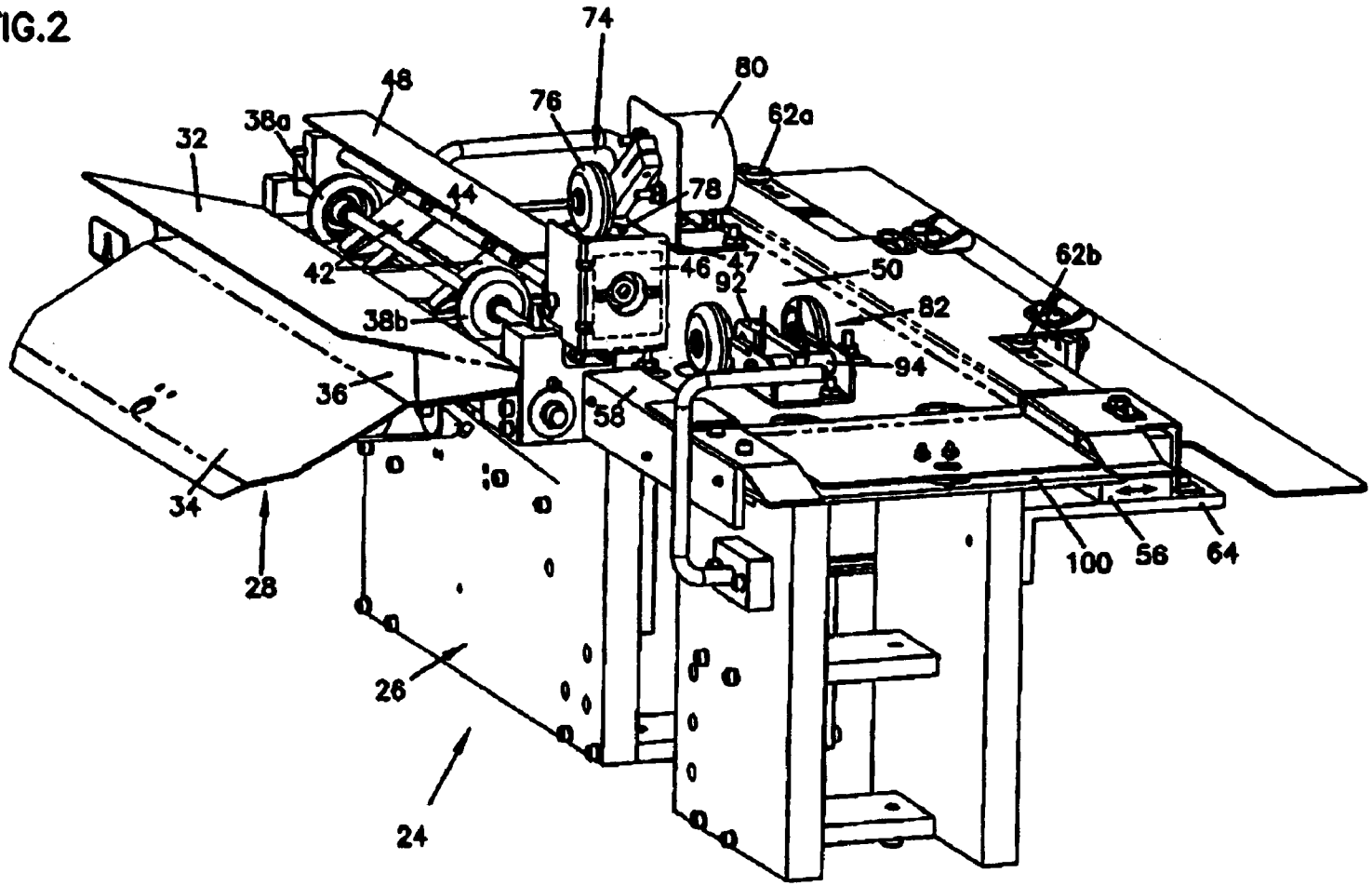
FIG. 2 is a perspective view of the apparatus of the invention.
Figure 5:
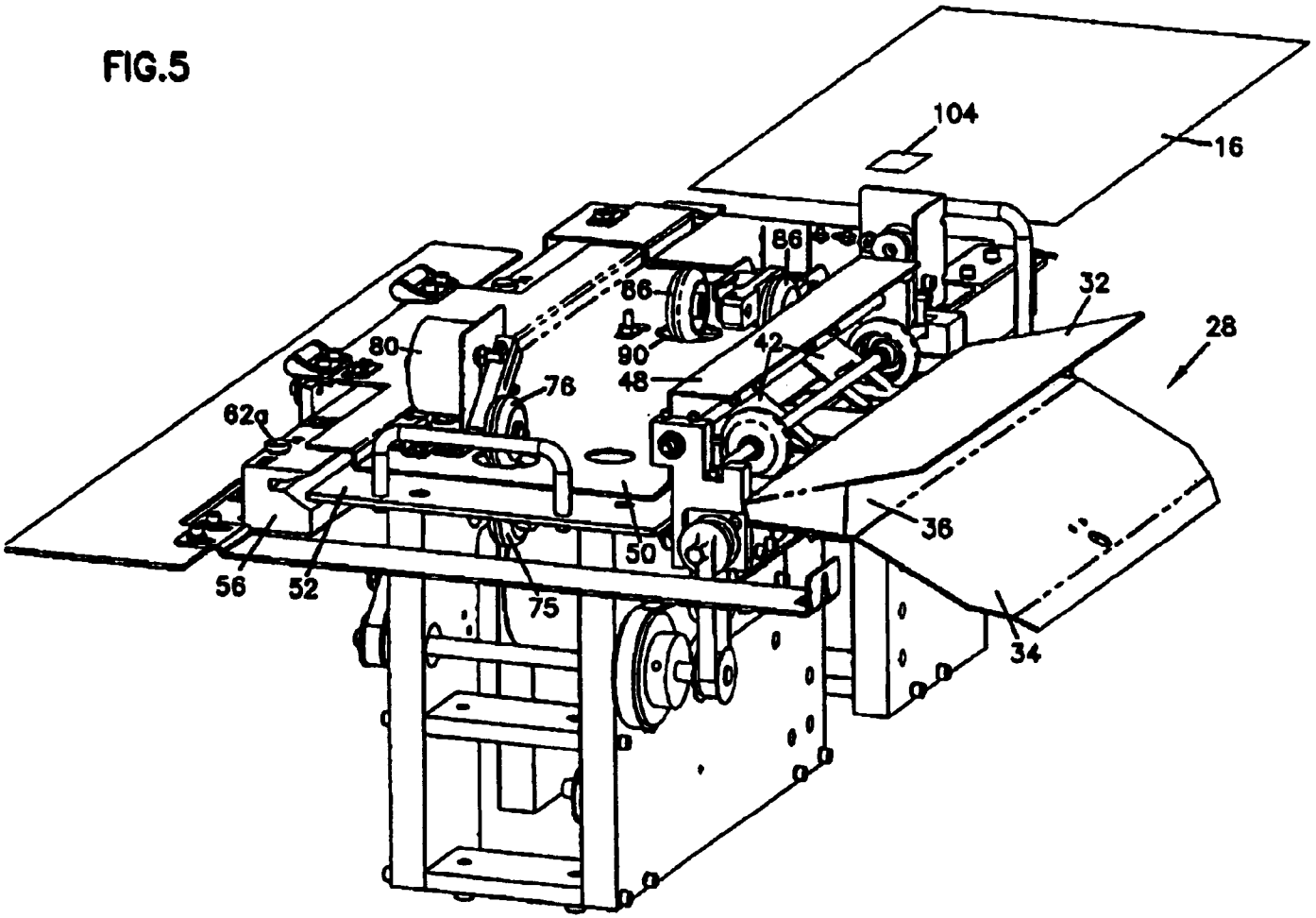
FIG. 5 is a perspective view of the apparatus viewed from an opposite end of the apparatus.

With reference to FIGS. 2, 3 and 5, the input 28 comprises upper and lower guide plates 32, 34 that define an inlet throat 36 for receiving the forms. The plates 32, 34 cooperate with the upstream printer 18 to ensure that the forms enter the throat 36. The input 28 further includes entry roller pairs 38*a*, 38*b* which take each form and drive the form, side edge first, further into the apparatus 24. Each roller pair 38*a*, 38*b* comprises a pair of upper and lower rollers (only the upper rollers are visible in the figures) which define a roller nip therebetween. The rollers are preferably constantly driven through a suitable drive mechanism by a drive motor (not shown), for example an AC induction motor. A suitable mechanism for driving the rollers would be known to a person of skill in the art having read this specification.

A paper guide 40 is also provided at the input 28 for controlling the input of forms into the apparatus. The paper guide 40, which comprises a part of the forms input 28, guides each form to a position above a stack of forms in the apparatus 24 where the form is then deflected by a top guide path plate 50 (to be later described) down onto the top of the stack.

A plurality of flipper plates 42 are attached to an actuating shaft 44, as best seen in FIGS. 2 and 5. The shaft 44 is connected to and actuated by an actuator 46 (shown in dashed lines in FIG. 2), for example a rotary actuator. The actuator 46 mounts to a plate 47. The shaft 44 is actuatable by the actuator 46 between a position shown in FIG. 2 where the plates 42 are disposed at an angle to a vertical axis, and a position (not shown) where the plates 42 are disposed generally vertically. When the plates 42 are at an angle, the form is moved from the printer to the top of the stack of forms. After the form is on the stack, the plates 42 are rotated to the vertical position behind the form to push the form against a first edge guide 56 (to be later described) The plates 42 stay vertical until the form has been pushed under the rollers 86 (to be later described). Once this occurs, the plates 42 are then actuated back to the angled position for the next form. In addition, at the vertical position, the plates 42 define a portion of one side of a form guide path through the apparatus.

Figure 4:
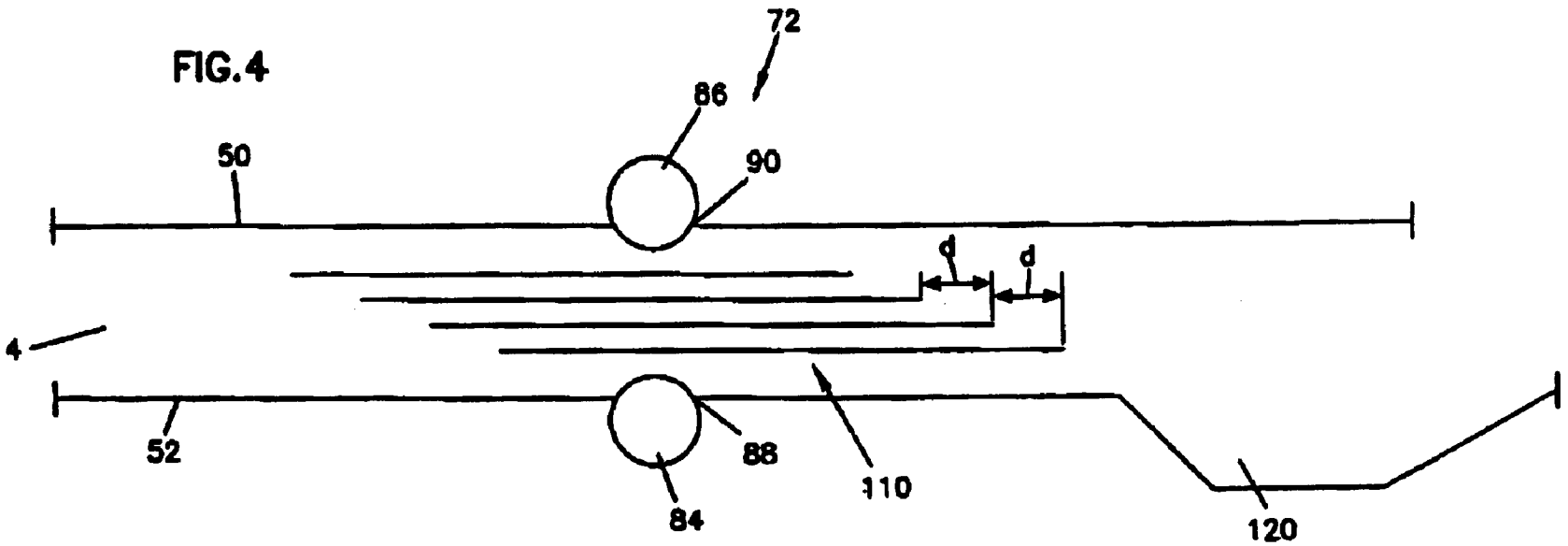
FIG. 4 is a schematic depiction of the shingled stack of forms and the recessed area of the stack area.

In use, the plates 42 are disposed behind a shield 48 which is connected to a top guide path plate 50, as shown in FIGS. 2 and 5. The shield 48 provides a handle for the plate 50 to facilitate removal of the plate 50. With reference to FIGS. 3–5, positioned opposite the top plate 50 and spaced therefrom is a bottom guide path plate 52. The top and bottom plates 50, 52 define therebetween a space 54 through which the forms travel through the apparatus 24. The forms enter the space 54 through the input 28 and the throat 36. In addition, a first edge guide 56 guides one edge of the forms, while a second edge guide 58, positioned opposite the edge guide 56, together with the flipper plates 42, guide the second edge of the forms.

The first edge guide 56 is preferably mounted to permit it to be adjusted toward and away from the second edge guide 58, as shown by the arrows in FIG. 2. In this way, the apparatus 24 can accommodate different paper sizes. With reference to FIG. 6, the edge guide 56 includes two sets of adjustment holes 60*a*, 60*b* which provide a guide to the user for adjusting the edge guide to the proper paper size requirements. For example, the sets of holes 60*a*, 60*b* can include holes 61*a*, 61*b* for adjusting the edge guide 56 to accommodate A4 sized forms, and holes for adjusting the edge guide 56 to accommodate Letter sized forms. In FIGS. 2, 3, 5 and 6, adjustment screws 62*a*, 62*b* are shown disposed within the holes for Letter sized forms. To adjust for A4 sized paper, the screws 62*a*, 62*b* are removed, and the edge guide 56 is moved inward toward the second edge guide 58 until the holes 61*a*, 61*b* align with corresponding threaded holes (not shown) provided in the plate 64. Once aligned, the screws 62*a*, 62*b* are inserted into the holes 61*a*, 61*b* and the holes in the plate 64 to lock the edge guide 56 in position. The adjustment back to the Letter size position occurs in a similar manner. Other holes for accommodating other form sizes, such as Legal size, can also be provided.

Turning now to FIGS. 3 and 6, the plates 50, 52 define a forms input area 70 at which each form that is input initially is disposed. The form is then transported downstream to a stack area 72 where a shingled stack of forms is created. The stack of forms is in a rear or home position when the form enters the input area 70 from the printer. Therefore, the form is placed on top of a stack at that time. A mechanism is provided to move the form from the input area 70 to the stack area 72 and position the form on the stack so that the form has the correct spacing relative to the forms beneath it.

At the input area 70, a roller mechanism 74 is provided. The roller mechanism 74 comprises a driven roller 75 (shown in FIG. 5) that extends upwardly through a space provided in the bottom plate 52 to engage the bottom of the form, and disposed opposite thereto an idler roller 76 that extends downwardly through a space 78 provided in the top plate 50 to engage the top of the form. The driven roller 75 is driven by a motor, for example an AC induction motor which can be the same motor used to drive the roller pairs 38*a*, 38*b* or a different motor.

The idler roller 76 is mounted so as to be movable toward and away from the driven roller 75. When the idler roller 76 is away from the driven roller 75, a form can enter the input area 70. After a form has entered the area 70, the idler roller 76 is actuated toward the driven roller 75 to engage the top of the form. This permits the form to be driven toward the stack area 72. The idler roller 76 is actuated up and down by an actuator 80, such as a rotary actuator.

A roller mechanism 82 is also provided at the stack area 72. The roller mechanism 82 is designed to engage the stack of forms at the stack area 72 and move the stack toward and away from the affix module 16. The roller mechanisms 74 and 82 are spaced apart a distance such that the roller mechanism 74 engages only a single form for driving each form to the stack area 72 and into engagement with the roller mechanism 82, while the stack of forms at the stack area 72 is engaged only by the roller mechanism 82. For Letter and A4 sized forms, a suitable distance between the nip of each roller mechanism 74, 82 is about 10.875 inches.

The roller mechanism 82 comprises a pair of spaced driven rollers 84 (one roller 84 is visible in FIG. 3), and idler rollers 86 opposite the driven rollers 84. As shown in FIG. 3, the rollers 84 extend upwardly through spaces 88 provided in the bottom plate 52 to engage the bottom of the lowermost form in the stack of forms, while the idler rollers 86 extend downwardly through spaces 90 provided in the top plate 50 to engage the top of the uppermost form in the stack.

The rollers 84 are driven both forwardly and in reverse by a suitable drive motor (not shown), for example a stepper motor. The idler rollers 86 are connected to a pivot arm 92 which is mounted on a pivot shaft 94. A spring (not shown) biases the pivot arm 92 downward, thereby biasing the idler rollers 86 toward the rollers 84.

The top and bottom plates 50, 52 also define an output 100 therebetween through which each form is discharged to the affix module 16. Each form is output individually to the affix module as a result of the roller mechanism 82 driving the stack of forms toward the output 100. As the roller mechanism 82 drives the stack of forms toward the output 100, the bottommost form in the stack is driven into the nip of exit rollers. The exit rollers take the bottom form and transport the form a short distance further to ensure that the form is out of the nip of the roller mechanism 82. The exit rollers then transport the form for affixing the card(s) thereon. As shown schematically in FIGS. 5 and 6, it is preferred that the exit rollers 104 be part of the affix module 16. One or more additional sets of exit rollers could be provided in the module 16 for accepting forms.

The distance between the nip of the roller mechanism 82 and the nip of the exit rollers 104 is chosen to permit the above operation. For Letter and A4 sized forms, a suitable distance between the nip of the roller mechanism 82 and the exit rollers 104 is about 10.875 inches. For other form sizes, this distance would change.

FIG. 4 schematically depicts the stack area 72 with a stack of forms 110 formed between the plates 50, 52. The spacing between the forms and the rollers, and between the forms and the plates 50, 52 are exaggerated for purposes of this description, it being understood that the bottommost form rests on the plate 52 and there is minimal spacing between the uppermost form and the plate 50. In addition, although space is shown between each form, it is to be understood that in use, the forms will be stacked on top of each other with effectively no space therebetween.

In the stack 110, the forms are disposed in a shingled manner, so that the leading edge of each form (except for the bottommost form) is set back from the leading edge of the form immediately beneath it. The setback distance d is the same for each form, with the distance varying depending upon the number of forms that are to be stacked. The distance d is preferably between about 0.65 to about 1.3 inches. In the preferred embodiment, the stack 110 contains a maximum of six sheets, in which case the distance d is about 1.3 inches. However, the stack can accommodate up to twelve forms, in which case the distance d will be about 0.65 inches. A person of ordinary skill in the art have read this specification would understand that other set-back distances could be used.

The apparatus 24 operates as follows. The one roller mechanism 82 controls the stack of forms 110 as it moves back and forth away from and toward the output 100. As a new form enters the input 28 from the printer, it is placed on top of the stack 110 in a shingled manner. Each new form enters the input area 70 at a point above the stack and is directed down onto the stack by the top plate 50. When a new form enters the input area 70, the stack is at its home position. As a result, the new form is placed on top of the stack before the new form is moved into the nip of the rollers 84, 86 by a mechanism comprising the roller pairs 38*a*, 38*b* and the roller mechanism 74. When the new form reaches the rollers 84, 86, the stepper motor starts and moves the entire stack a short distance downstream toward the output 100 to make the stack ready to accept a new form. This movement also establishes the set back distance for a new form that is later added to the top of the stack. Assuming a set back distance d of about 1.3 inches, the top form is placed on the stack about 1.3 inches to the left (when viewing FIG. 4) of the sheet below it.

To deliver a form to the affix module 16, the stack 110 is moved by the roller mechanism 82 to the right (when viewing FIG. 4) an amount to place the bottom form into the nip of the rollers 104. Due to the set back distance d, only the bottommost form enters the nip of the rollers 104. The leading edge of the bottommost form is grabbed by the rollers 104 which move the bottommost form, for example, about one more inch to the right (when viewing FIG. 4) to ensure that the bottommost sheet is out of the nip of the roller mechanism 82. The rollers 104 are now free to deliver the form to the affix module 16 for affixing the card(s) thereto.

After the bottommost form is delivered, the stack 110 is moved back to the home position (shown in FIG. 4) to receive the next form. When a request for a new form is received, an entry photocell (not shown) at the input 28 determines whether a new form is coming in. If a new form is entering the apparatus, the stack 110 is not moved toward the output 100 until the new form is placed on top of the stack 110.

As a new form exits the printer 18, it covers the entry photocell and the roller pairs 38*a*, 38*b* and the driven roller of the roller mechanism 74 are actuated. The new form is then placed on top of the stack 110. A photocell in the input area 70 senses the new form and activates the flipper plates 42 to the vertical position. This forces the form against the edge guide 56. The idler roller 76 is then actuated downward toward the driven roller for moving the form toward the stack area 72 and into the nip of the roller mechanism 82. The roller mechanism 82 then moves the new form and the stack 110 to the right about 1.3 inches (assuming a maximum of six sheets in the stack) so that when another form is added on top of the stack, the correct set back results.

As each new form is added to the top of the stack, the stack moves about 1.3 inches (assuming a maximum of six sheets in the stack) toward the output 100. Each request for a form from the affix module 16 moves the bottom form to the output, and each new form that enters the apparatus moves the stack 110 about 1.3 inches toward the output 100 (assuming a maximum of six sheets in the stack). These two operations occur asynchronously, and never at the same time. If a form is entering the apparatus 24, the stack waits for the form to be added to the top of the stack.

Once the bottom form is picked up by the rollers 104, the stack of forms must be permitted to move back to the home position without interfering with the picked-up bottom form now if the module 16. To accomplish this, the bottom plate 52 at the stack area 72 includes a recessed area 120 adjacent to and downstream from the roller mechanism 82. Once the bottom form is engaged by the rollers 104 and pulled into the module 16 about 1.0 inch, the rear edge of the bottom form drops into the recessed area 120. This takes the rear edge of the form out of the way before the form is taken completely into the affix module 16. This is important when there is one form on the stack and a new form enters the buffer and moves forward. Without the recessed area 120, as the new form moves forward it could hit the rear edge of the form that just entered the affix module 16.

As stated above, in the preferred embodiment, there are never more than six forms in the printer and buffer apparatus at any one time. As a result, when a form exits the apparatus, data is sent to the printer for a new form to be printed. If there is no request for a new form from the affix module 16, six forms will stack in the buffer apparatus 24. However, there could be less than six forms in the apparatus 24 when the system 12 stops, in which case the remaining forms in progress in the printer will finish printing and then be stacked in the apparatus 24 waiting for restart.

The apparatus 24 is capable of handling up to 3000 forms or more per hour. Further, the apparatus is capable of handling 24 to 42 pound bond paper.

The above specification, examples and date provide a complete description of the invention. Many embodiments of the invention, not explicitly described herein, can be made without departing from the spirit and scope of the invention.

What is claimed is:

1. A method of storing and synchronizing forms being transferred between a forms printer and a device for attaching personalized cards to the forms, comprising:

providing a forms buffer apparatus between the printer and the attaching device;

discharging forms from the printer into the forms buffer apparatus;

stacking the forms in the forms buffer apparatus so that a leading edge of each form is set back from the leading edge of the form immediately beneath it thereby creating a shingled stack;

moving the shingled stack toward an output to discharge the lowermost form from the shingled stack; and moving the shingled stack back to a home position to permit reception of another form onto the top of the shingled stack.

2. The method of claim 1, comprising stacking the forms so that the leading edges of the forms in the shingled stack are set back substantially the same distance.

3. The method of claim 2, wherein the distance is about 1.3 inches.

4. The method of claim 2, comprising moving the shingled stack toward the output a predetermined distance as each new form is added to the top of the shingled stack.

5. The method of claim 4, wherein the predetermined distance is substantially equal to the set back distance.

6. An apparatus for storing and synchronizing forms that are transferred between a forms printer and a device for attaching personalized cards to the forms, comprising:

an input configured to permit reception of forms from the forms printer;

an output through which forms are discharged to the device for attaching personalized cards;

a stack area between the input and output that is configured and arranged to contain a stack of forms;

a first mechanism that is configured and arranged to transport forms from the input to the stack area; and a second mechanism at the stack area that is configured and arranged to transport the stack of forms toward and away from the output.

7. The apparatus of claim 6, wherein the first mechanism and second mechanism are positioned relative to one another such that the stack of forms is engaged only by the second mechanism.

8. The apparatus of claim 6, wherein the first mechanism comprises input rollers associated with the input.

9. The apparatus of claim 8, further including a forms input area adjacent to and upstream of the stack area, and the first mechanism further includes a roller mechanism at the input area.

10. The apparatus of claim 9, wherein the roller mechanism comprises a driven first roller, and a second roller that is moveable toward and away from the first roller.

11. The apparatus of claim 6, wherein the second mechanism comprises a roller mechanism.

12. The apparatus of claim 10, wherein the roller mechanism comprises a pair of spaced, driven rollers and a pair of idler rollers opposite the driven rollers.

13. The apparatus of claim 12, wherein the idler rollers are biased toward the driven rollers.

14. The apparatus of claim 11, wherein the stack area includes a bottom plate upon which the stack rests, and further including a recessed area in the bottom plate adjacent to and downstream from the roller mechanism.

15. The apparatus of claim 6, further comprising a guide path between the input and the output, said guide path being defined at least in part by a bottom plate, a top plate positioned opposite to and spaced from the bottom plate, a first edge guide, and a second edge guide positioned opposite to and spaced from the first edge guide.

16. The apparatus of claim 15, wherein the first edge guide is mounted to permit adjustment thereof toward and away from the second edge guide.

* * * * *